US006726158B2

(12) United States Patent
Issa

(10) Patent No.: US 6,726,158 B2
(45) Date of Patent: Apr. 27, 2004

(54) REST DEVICE FOR THE HAND AND A SUPPORT DEVICE FOR THE FOREARM

(76) Inventor: Abood Issa, Ekebyhovsvagen 6a, 178 30 Ekero (SE)

( * ) Notice: Subject to any disclaimer, the term of this patent is extended or adjusted under 35 U.S.C. 154(b) by 0 days.

(21) Appl. No.: 10/182,111

(22) PCT Filed: Jan. 25, 2001

(86) PCT No.: PCT/SE01/00142

§ 371 (c)(1),
(2), (4) Date: Jul. 23, 2002

(87) PCT Pub. No.: WO01/55809

PCT Pub. Date: Aug. 2, 2001

(65) Prior Publication Data

US 2003/0010876 A1 Jan. 16, 2003

(30) Foreign Application Priority Data

Jan. 26, 2000 (SE) ..... 0000232

(51) Int. Cl.[7] ..... B43L 15/00
(52) U.S. Cl. ..... 248/118.1; 248/918; 248/624
(58) Field of Search ..... 248/118, 118.1, 248/118.3, 118.5, 918, 624; 400/715, 717, 718; 602/21, 64; 607/111

(56) References Cited

U.S. PATENT DOCUMENTS 4,069,995 A * 1/1978 Miller ..... 248/118.1
5,398,896 A * 3/1995 Terbrack ..... 248/118.5
5,788,195 A * 8/1998 Rice ..... 248/118.5
5,918,839 A * 7/1999 DuBois ..... 248/118
6,267,336 B1 * 7/2001 Ruckstadter ..... 248/118.3
6,402,100 B1 * 6/2002 Rice ..... 248/118

FOREIGN PATENT DOCUMENTS

JP 2002-248898 * 9/2002

* cited by examiner

*Primary Examiner*—Gwendolyn Baxter
(74) *Attorney, Agent, or Firm*—Rolf Fasth; Fasth Law Offices

(57) ABSTRACT

The rest device is for the hand and support device for the forearm of a person, who performs repeated rotational, lifting and pressure moments with his/her hand. The device has a resilient moveable rest and support part (1), which receives the forearm and has a plane central part (2) as well as at least two sector parts (3,4,5,6). Resilient elements, such as compression springs, exert a pressure arranged in a vertical direction below the sector parts (3,4,5,6) adjacent to the circumference (P) and consequently on each side of the part (7,8,9,10). The lifting, lowering and rotational movements of the hand and its fingers are being facilitated and resiliently damped by means of the rest and support part due to the reaction properties of the springs.

3 Claims, 7 Drawing Sheets

REST DEVICE FOR THE HAND AND A SUPPORT DEVICE FOR THE FOREARM

PRIOR APPLICATIONS

This application is a U.S. national phase application based upon International Application No. PCT/SE01/00142, filed Jan. 25, 2001; which claims priority from Swedish Application No. 0000232-9, filed Jan. 26, 2000.

TECHNICAL FIELD

The present invention relates to a rest device for the hand and a support device for the forearm of a person, who performs repeated hand movements such as rotational, lifting and pressure motions with his/her hand and its fingers, e.g. when using a computer mouse, during a rehabilitation of hands and arms having various types of stress injuries.

BACKGROUND AND SUMMARY OF THE INVENTION

In the above-mentioned technical field there are many different types of solutions regarding constructions designed to support the forearm, when a work is performed using the hand and its fingers. These constructions are often clumsy and difficult to use, since they are not ergonomically designed and consequently reduces the freedom of movement of the user. Others are constructed in a simple way and consequently sometimes are not very efficient.

A few examples of such already known constructions are described in U.S. Pat. Nos. 4,973,176, 5,265,835, 5,335,888 and 5,490,647.

The object of the present invention is to eliminate the above-mentioned drawbacks of known rest and support devices for the hand and the arm, when the hand and its fingers are used, and to allow the hand to occupy a position, which is comfortable for the body and in this way to spare the shoulders, the arms and the back during these activities as well as to prevent, that i.e. the disability "mouse arm" arises.

When a person is using a computer mouse for an extended period of time a fatigue of the shoulder arises, causing the hand to not be able to move sufficiently rapidly.

The object of the present invention is to generate a reaction against the activity of the hand and in this way counteract these phenomena.

According to the inventive idea the above-mentioned problems are solved by the measure, that said device comprises a resilient moveable rest and support part, which receives the forearm, comprises a plane central part as well as at least two hump-like sector parts, which extend upwards at an angle from the central art and which in pairs are positioned on the same half of the device, as well as at least one part, which extends downwards between said sector parts at an angle to said plane central part, the rest and support device being supported by resilient elements, which exert a pressure, preferably compression springs or the like, positioned below each sector partly adjacent its circumference and consequently on each side of one of the parts, which extend downwards, the lifting, lowering and rotational movements of the hand and its fingers being facilitated and the forearm thereby being resiliently damped by means of the rest and support part thanks to the reaction properties of the springs.

According to the invention a device is obtained, which is easy to handle and which counteracts the development of fatigue of the shoulder, since it facilitates the various movements of the hand and the fingers, is flexible regarding its utilization, is easy and consequently economic to manufacture, has a long life and can be used by different persons regardless of the size of the hand and the arm.

BRIEF DESCRIPTION OF DRAWINGS

The invention will now be described, reference being made to the enclosed drawings, in which.

DETAILED DESCRIPTION

Figure 1:
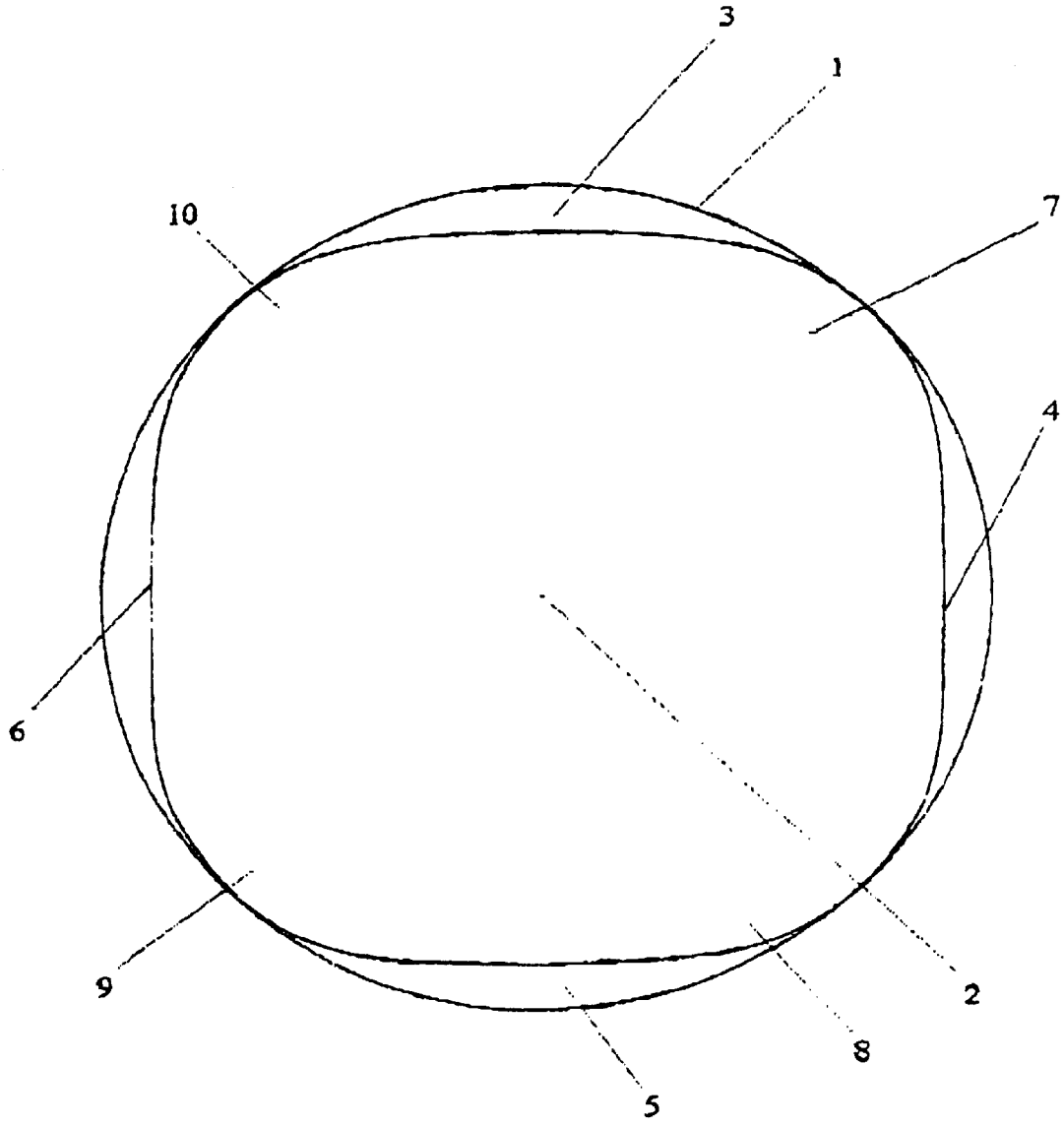
FIG. 1 shows a first embodiment of the invention, seen from above.

FIG. 1 shows a first embodiment of the invention, seen from above. In FIGS. 1–10 it is shown, that the device comprises a rest and support part 1, which has a mainly round, convex shape with a plane smaller circular central part 2 as well as four hump-shaped sector parts 3,4,5,6 which extend upwards at an angle and in pairs are positioned on the same half of the device as well as between said parts, at an angle to the plane central part 2, parts 7,8,9,10 which extend downwards, the device being supported by compression springs 11,12,13,14 disposed in a vertical direction below each sector part 3,5,5,6 preferably adjacent its circumference P and consequently on each side of parts 7,8,9, 10 which extend downwards the lifting lowering and rotational movements of the hand being facilitated when the forearm his been positioned along the same line as two of parts 7,8,9,10 which extend downwards and is supported by the central part 2 of the device and consequently is resiliently damped by rest and support part 1 due to the reaction properties of springs 11,12,13,14.

Figure 2:
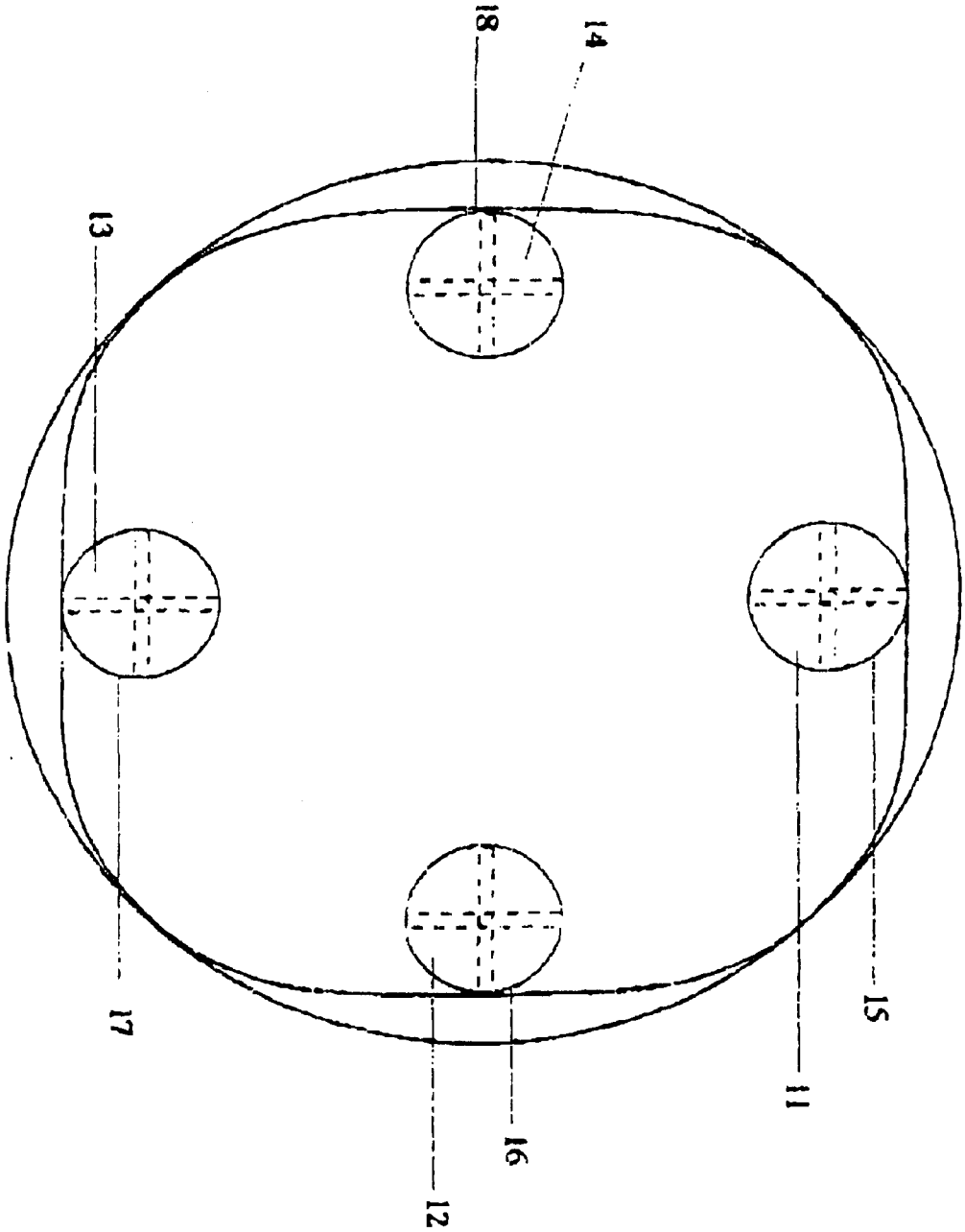
FIG. 2 shows the first embodiment, seen from below, provided with four support legs.

FIG. 2 shows the rest and support part of the first embodiment, seen from below, provided with four support legs 15,16,17,18 in which compression springs 11,12,13,14 are disposed.

Figure 3:
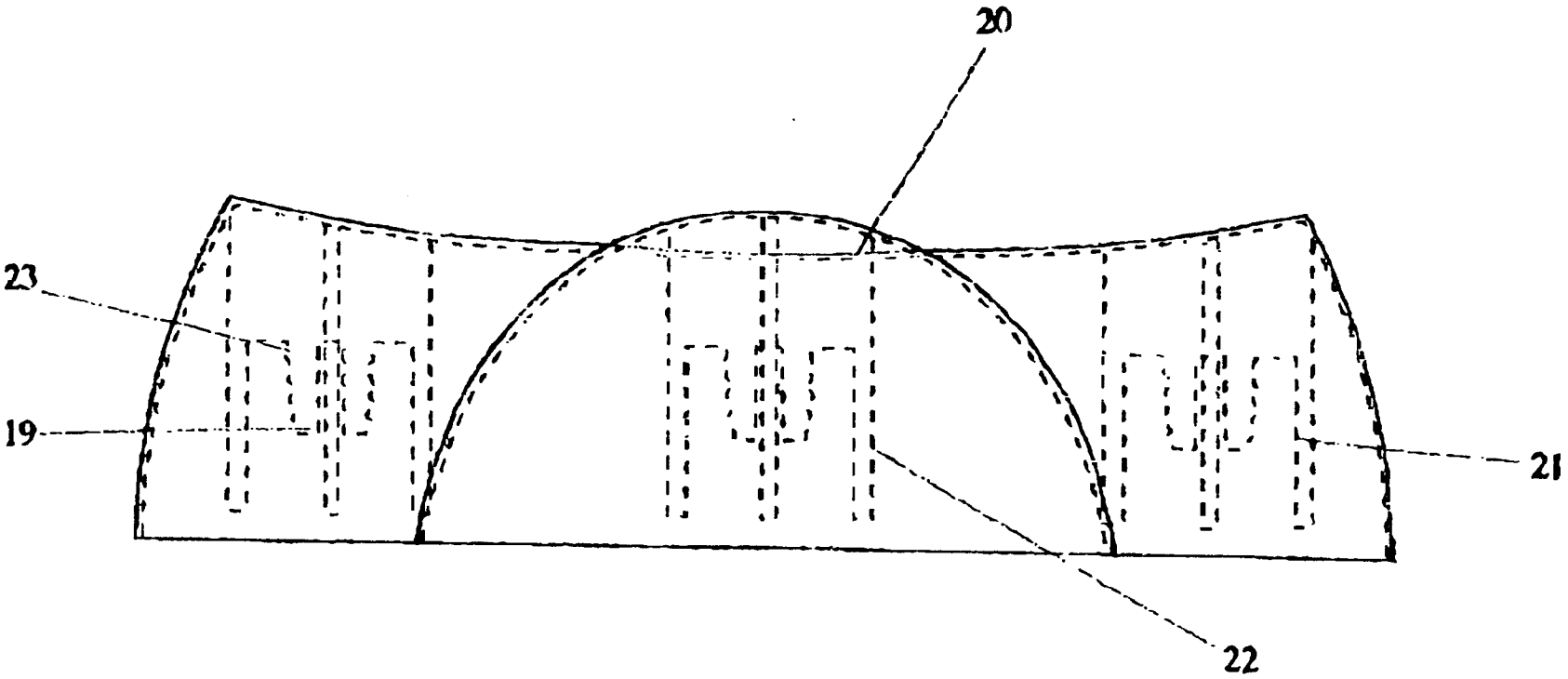
FIG. 3 shows in a lateral view the rest and support part in FIGS. 1 and 2 with dashed lines for cavities, designed to receive support legs.
Figure 4:
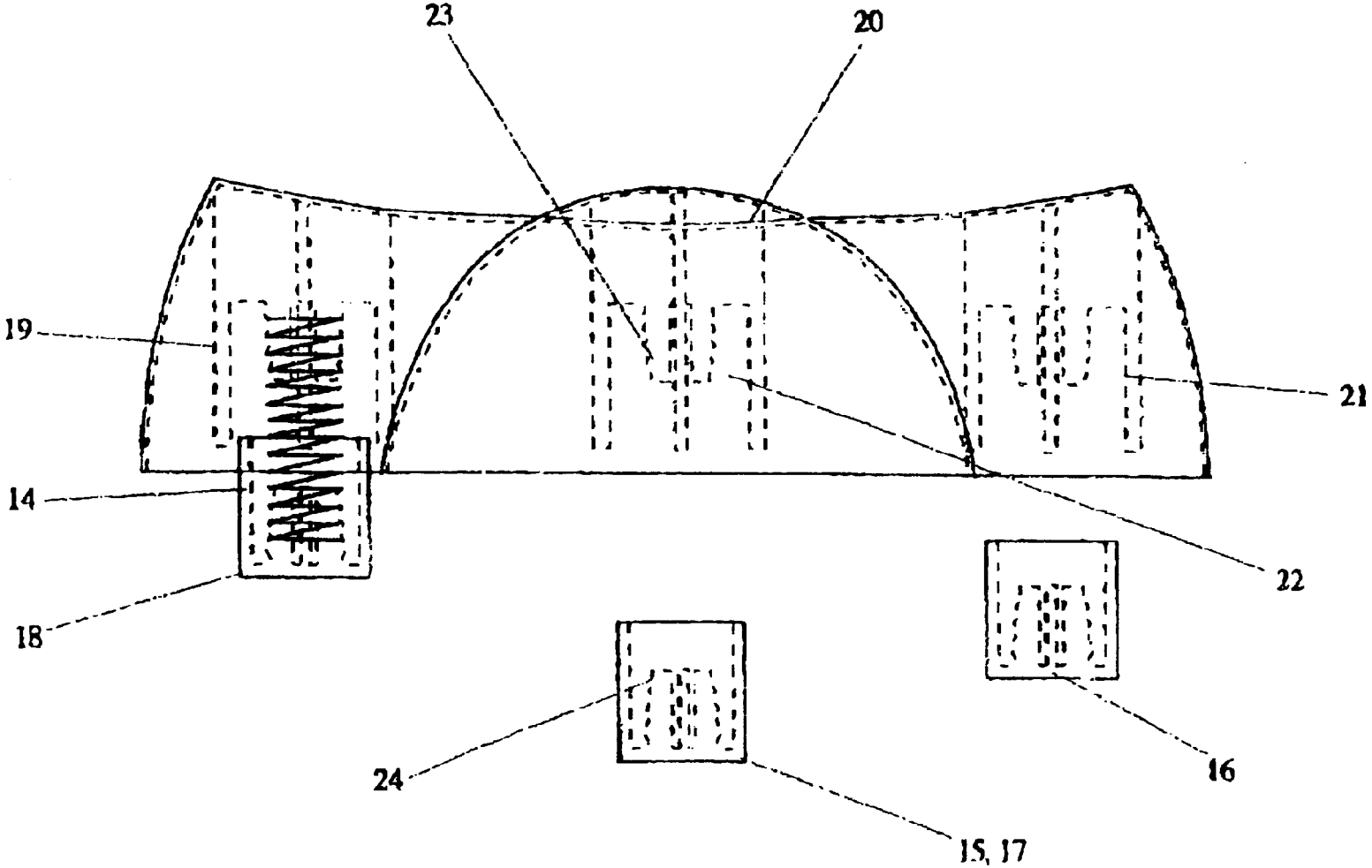
FIG. 4 shows a support leg, received in one of the cavities in FIG. 3 as well as a compression spring, arranged in the cavity.

In FIGS. 3 and 4 cavities 19,20,21,22 are shown with dashed lines, positioned in rest and support part 1 for springs 11,12,13,14 and support legs 15,16,17,18. Cavities 19,20, 21,22 as well as support legs 15,16,17,18 are provided with inner resilient conical pins designed to receive compression springs 11,12,13,14 when the legs are mounted in cavities 19,20,21,22.

Figure 5:
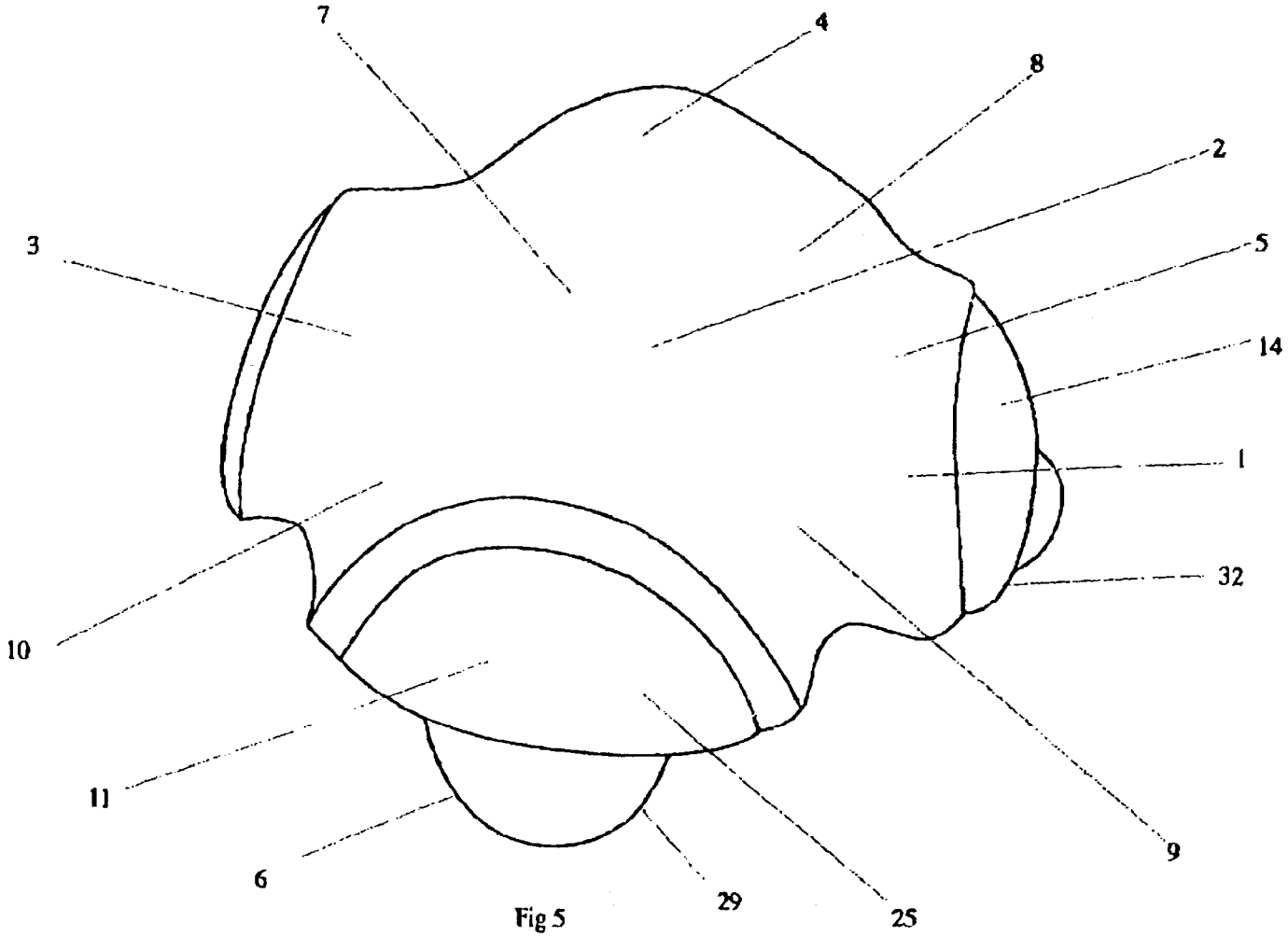
FIG. 5 shows in a lateral view another embodiment of the invention, which comprises a rest and support part as well as a lower part.

In FIG. 5 another embodiment of the invention is shown, in a lateral view, which comprises a rest and support part 1 as well as a lower part 25, which comprises a plate 26, which with circular parts, arranged around its circumference and provided with recesses 29,30,31,32 for compression springs 11,12,13,14 is positioned in a vertical direction between rest and support part 1 and the lower part.

Figure 6:
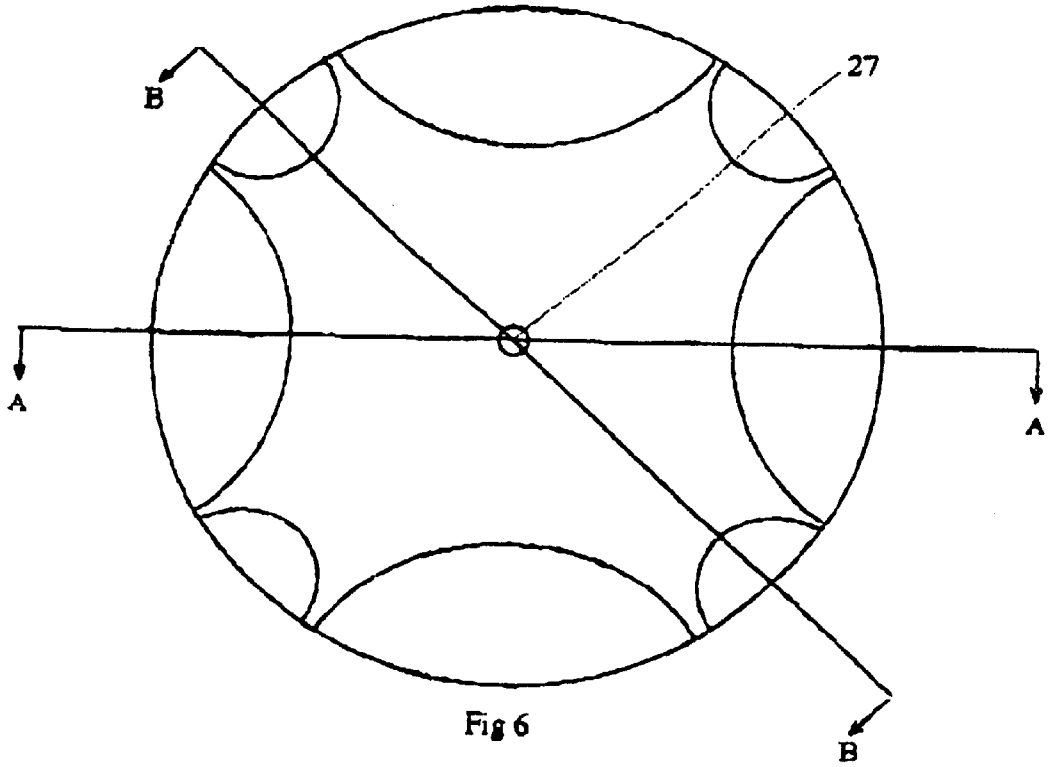
FIG. 6 shows the rest and support part in FIG. 5 seen from above.

FIG. 6 shows the rest and support part of the embodiment in FIG. 5 seen from above. A tension spring 27 is in its one end fastened to the central part of rest and support part 1 and in its other end fastened to the central part of plate 26 of the lower part.

Figure 7:
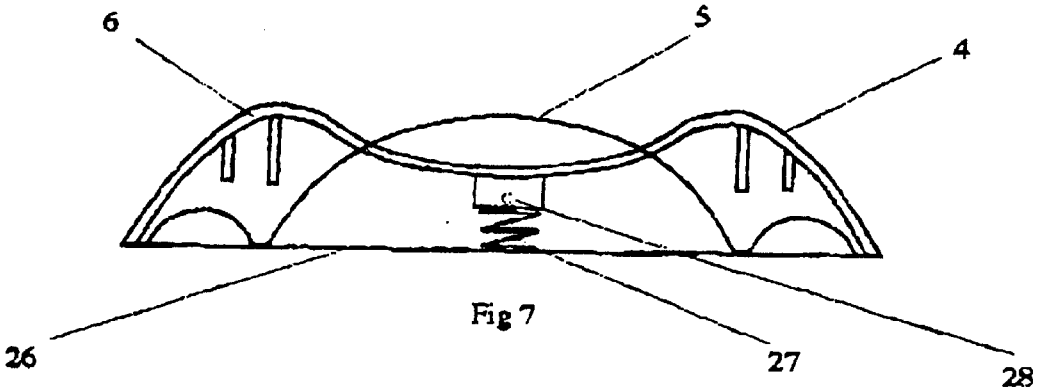
FIG. 7 shows the rest and support part in cross-section along line A—A in FIG. 6.

FIG. 7 shows a cross-section of the rest and support part in FIG. 6 along line A—A in FIG. 5 in which the fastener of tension spring 27 in the rest and support part is shown at 28. The hump-shaped sector parts 4,5,6 and the parts, which extend downwardly are also shown.

Figure 8:
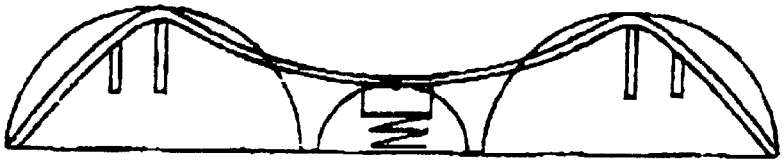
FIG. 8 shows the rest and support part in cross-section along line B—B in FIG. 5.

FIG. 8 shows a cross-section through the rest and support part in FIG. 6 along line B—B in FIG. 5.

Figure 9:
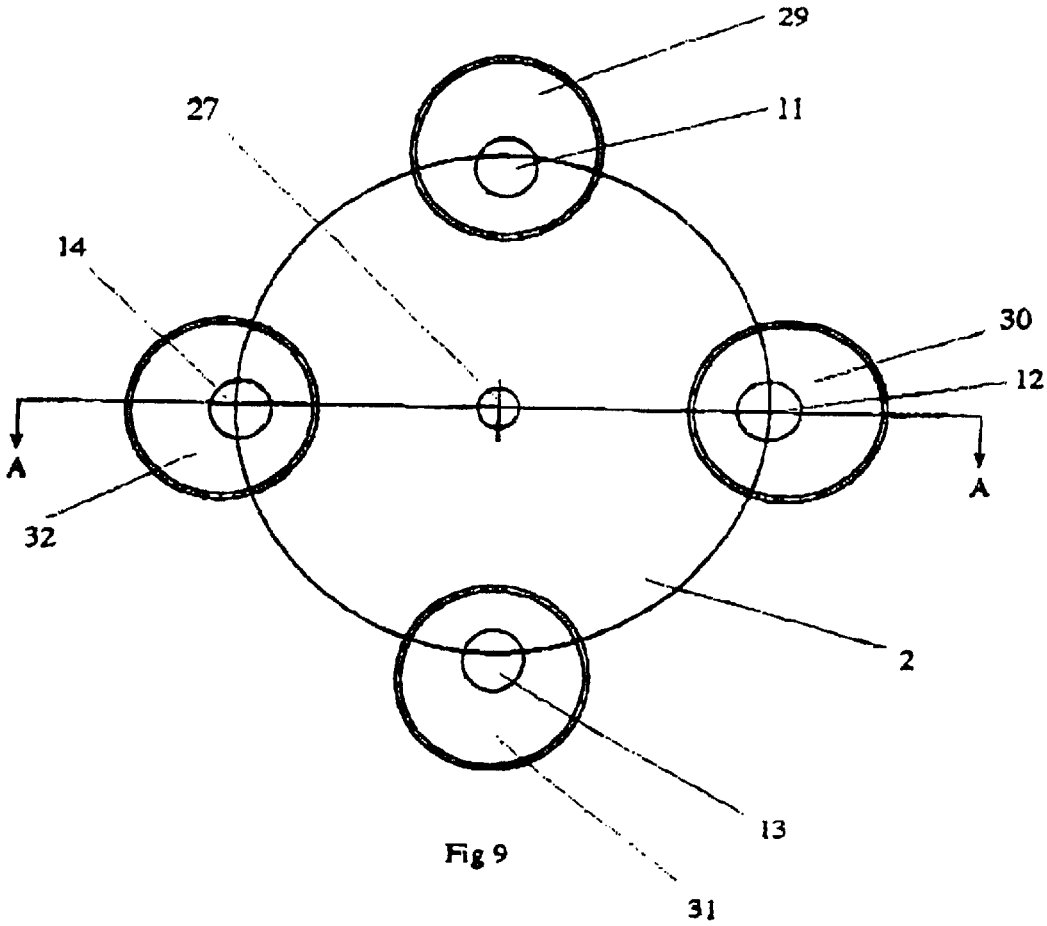
FIG. 9 shows the lower part of the embodiment in FIG. 5 seen from above and FIG. 10 shows a cross-section of the lower part in FIG. 5 along line A—A in FIG. 6.

FIG. 9 shows lower part 25 in FIG. 5 seen above with tension spring 27 in the central part as well as compression springs 11,12,13,14 which are supported by support means at its circumference. Around the circumference of plate 26 the circular parts with recesses 29,20,31,32 for the compression springs are arranged.

Figure 10:
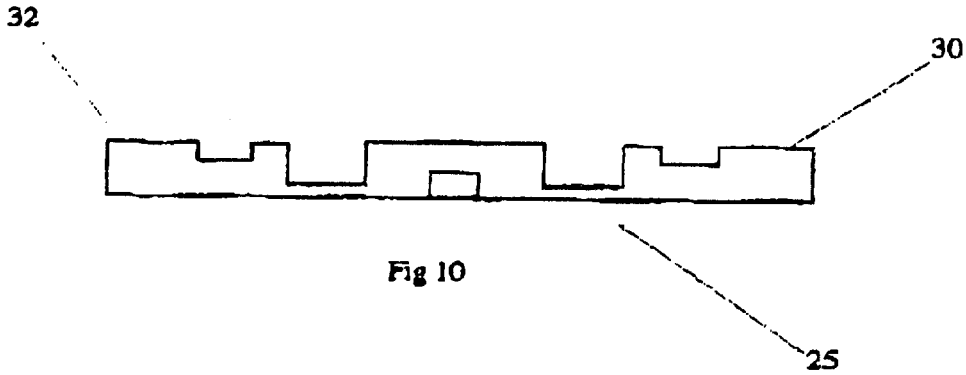

FIG. 10 shows lower part 25 in cross-section along line A—A in FIG. 9 with the fastener for tension spring 27 as well as the parts with recesses 29,30,31,32 for the compression springs. The compression springs can be selected among all variants of resilient elements, which can exert a pressure.

The intention can also be utilized during computer use for disabled persons, who use wheel chairs. The device is then positioned on a table, arranged adjacent or on the wheel chair and allows the user to support his/her arm in a position, which is comfortable for the back and the user does not have bend his/her beck and exert a pressure on arm and shoulders, when the computer mouse is used.

The invention can also be used when rehabilitating other types of stress injuries, such as tennis elbow, developed during tennis play, or caused by work for a long time with the manufacturing of printed circuit cards, assembly work and paperwork. The device can be equipped with a vibrating element in order to massage the user's arm by means of vibrations.

While the present invention has been described in accordance with preferred compositions and embodiments, it is to be understood that certain substitutions and alterations may be made thereto without departing from the spirit and scope of the following claims.

What is claimed is:

1. A rest device for a hand and a support device for a forearm of a person, who performs repeated rotational, lifting and pressing moments with the hand and fingers of the hand when using a computer mouse, during various intensive work moments with the hand as well as during rehabilitation of hands and arms having various types of stress injuries;

characterized in that the device comprises a resilient movable rest and support part (1) which will receive the forearm and comprises a plane central part (2) as well as at least two hump-shaped sector parts (3,4,5,6) which extend upwards at an angle from the central part and in pairs are positioned on the same half of the device as well as parts (7,8,9,10) which extend downwards to the plane central part at an angle, the rest and support device (1) being supported by means of resilient elements, which exert a pressure preferably compression springs (11,12,13,14), arranged in a vertical direction below the hump-shaped sector parts (3,4,5,6) adjacent a circumference (P) and consequently on each side of the part (7,8,9,10) which extends downwards the lifting, lowering and rotational movements of the hand and fingers of the hand being facilitated and resiliently damped by means of the rest and support part due to reaction properties of the springs.

2. A rest and support device according to claim 1, wherein the sector parts (3,4,5,6) are four in number.

3. A rest and support device according to claim 2, wherein a tension spring (27) is fastened to the central part of the support device (1) and to the central part of a lower part (25).

* * * * *